US007466278B1

(12) United States Patent
Gerhard

(10) Patent No.: US 7,466,278 B1
(45) Date of Patent: Dec. 16, 2008

(54) BUOYANT CABLE ANTENNA SYSTEM AND METHOD WITH ARTICULATING BLOCKS

(75) Inventor: Erich M. Gerhard, deceased, late of South Kingstown RI (US); by Heidi R. Pickreign, legal representative, Harvard, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 20 days.

(21) Appl. No.: 11/650,763

(22) Filed: Dec. 26, 2006

(51) Int. Cl.
*H01Q 1/34* (2006.01)

(52) U.S. Cl. ..... 343/709; 343/719

(58) Field of Classification Search ..... 343/709, 343/719, 881, 882
See application file for complete search history.

(56) References Cited

U.S. PATENT DOCUMENTS 1,667,510 A 4/1928 Coe
1,810,079 A 6/1931 Jennison
2,419,053 A 4/1947 Bennett
3,599,213 A * 8/1971 Fessenden et al. ..... 343/710
4,774,519 A * 9/1988 Pease et al. ..... 343/709
4,978,966 A 12/1990 Takizawa et al.
5,933,117 A 8/1999 Gerhard
6,461,079 B1 * 10/2002 Beaujean ..... 405/171
6,870,508 B1 * 3/2005 Rivera ..... 343/709

* cited by examiner

*Primary Examiner*—Hoang V Nguyen
(74) *Attorney, Agent, or Firm*—James M. Kasischke; Michael P. Stanley; Jean-Paul A. Nasser

(57) ABSTRACT

A buoyant cable system and method is provided with a towed platform that is flexible for deployment into the water from a submerged submarine. The towed platform has a memory that returns to a selected shape after deployment. In one embodiment the biasing member is a spring acting against and anchored to Kevlar® strands running through the blocks such that the blocks are compressed into a desired shape during operation but remain sufficiently flexible for deployment and retrieval. In another embodiment, a keel may be formed from a weighted curved portion that is suitable for vertically supporting an antenna above the surface of the water to prevent signal interference due to water washing over the towed transmission line.

18 Claims, 3 Drawing Sheets

BUOYANT CABLE ANTENNA SYSTEM AND METHOD WITH ARTICULATING BLOCKS

STATEMENT OF THE GOVERNMENT INTEREST

The invention described herein may be manufactured and used by or for the Government of the United States of America for Governmental purposes without the payment of any royalties thereon or therefore.

CROSS REFERENCE TO RELATED PATENT APPLICATION

The instant application is related to three co-pending U.S. patent applications entitled BUOYANT CABLE ANTENNA CONFIGURATION AND SYSTEM Ser. No. 11/650,762, SERPENTINE BUOYANT CABLE ANTENNA SYSTEM Ser. No. 11/650,764, BUOYANT CABLE ANTENNA SYSTEM Ser. No. 11/650,761 having the same filing date.

BACKGROUND OF THE INVENTION (1) Field of the Invention

The present invention relates generally to a flexible antenna system and, in a more particular preferred embodiment, to a buoyant cable antenna system with articulating blocks which provide flexibility for deployment and a predetermined shape after deployment.

(2) Description of the Prior Art

Buoyant cable antennas are well known for use by submarines especially when the submarine is submerged. Such cables have been used to receive radio signals in the very low frequency and low frequency (VLF/LF) transmission bands. Present buoyant cable antenna systems consist of a horizontal wire antenna for reception of signals in the range of from about 10 kHz to 130 kHz.

The buoyant cable antenna floats on the ocean surface and is deployed with a buoyant cable. The horizontal antenna element lies on the surface of the ocean and reception is limited by transmission line attenuation, amplifier gain and antenna characteristics. Seawater attenuation, antenna gain and frequency patterns limit the usefulness of the horizontal antenna element.

The buoyant cable antenna must be flexible because a submerged submarine preferably launches the cable antenna through a transfer mechanism which bends the cable through a six-inch radius. Because flexibility is required, buoyant cable antennas have employed a horizontal wire antenna element which receive signals from the fore and aft (front and back) direction relative to its deployment. This limitation of the antenna gain pattern reduces the reception capability of the buoyant cable antenna.

Various inventors have addressed similar problems related to buoyant cable antennas as discussed in the following patents. U.S. Pat. No. 5,933,117, issued Aug. 3, 1999, to the present inventor Erich M. Gerhard, is incorporated herein by reference, and discloses a buoyant loop antenna, deployable along a cable, which includes a core region comprising a plurality of annular ferrite beads. These annular shaped beads include a center hole and a generally concave first end and a generally convex second end. The ferrite beads are aligned with the concave end of one bead against the convex end of another bead. This allows the cable to flex while the beads maintain contact with each other, providing flexibility and resistance to crushing. The core region has a loop wire wrapped helically around it, forming the loop antenna. The loop wire element starts and ends at the same end of the core region, forming a loop. This loop allows transmission and reception in an athwart (side to side) direction. This wire loop antenna can be combined with a straight wire antenna (which provides reception in a fore and aft direction) to provide an omni-directional cable antenna assembly for VLF/LF frequency ranges.

U.S. Pat. No. 1,667,510, issued Apr. 24, 1928, to J. R. Coe, discloses a cable constituting an electrical conductor for high tension transmission lines having, in combination, a core comprising a plurality of short rigid members arranged end to end, and contacting wires of high electrical conductivity arranged spirally and side by side about said members.

U.S. Pat. No. 1,810,079, issued Jun. 16, 1931, to H. C. Jennison, discloses a conducting cable comprising a series of cups constituting a supporting means comprising a plurality of diaphragms and round contacting conductors spirally wound about the supporting means. The several cups have on their sides longitudinally extending surfaces aligning the cups within the spirally wound conductors. Adjacent end portions of adjacent cups are suitably nested so as to form ball and socket joints between them.

U.S. Pat. No. 2,419,053, issued Jul. 3, 1942, to C. E. Bennett, discloses an electric cable in which the weight to volume ratio is such to render the cable buoyant. The cable comprises a continuous water pervious tubular member, conductor strands laid up about the tubular member or core, and a sheath of insulating material about the conductor strands. Floats are threaded upon the sheath and rigidly secured thereto. The adjacent ends of the floats are telescoping with each other while permitting relative angular movement to provide a flexible structure.

U.S. Pat. No. 4,978,966, issued Dec. 18, 1990, to Takizawa et al., discloses an antenna with a plurality of rod-shaped cores aligned in an end-to-end relationship and an antenna coil wound on the core array throughout its entire length. This arrangement permits the antenna to bend and fit a curved surface of a car where the antenna is mounted.

U.S. Pat. No. 2,428,480, issued Oct. 7, 1947, to H. A. Tunstall, discloses a tubular buoyancy element comprising a longitudinally flexible helix resistant to radial compression and a flexible waterproof covering enclosing the helix. Means comprising expanded rubber plugs are provided within the covering and have peripheral surfaces molded to and closely fitting the internal surface thereof for dividing the interior of the element into a plurality of closed compartments.

U.S. Pat. No. 3,117,596, issued Jan. 14, 1964, discloses a buoyant flexible hose comprising helically wound reinforcement means comprising a pair of tubular members in laterally adjacent relation and having longitudinally spaced convolutions and a plastic carcass enclosing at least a portion of the reinforcement means. The carcass comprises an inner tubular wall portion and an outer helically corrugated wall portion having the valley portions thereof secured to opposed portions of said inner wall portion. A portion of the reinforcement means is disposed between the peak portions of the corrugated outer wall portion and opposed portions of the inner wall portion. Sealed helical air spaces are formed between the portion of the reinforcement means and opposed surface portions of the carcass wall portions enclosing the same. The sealed air spaces are disposed on either side of the portion of the reinforcement means.

U.S. Pat. No. 3,823,249, issued Jul. 9, 1974, to Floessel et al., discloses a compressed gas insulated electrical high voltage conductor assembly comprised of a number of pressurized gas filled rigid straight sections arranged in end to end relation. Each section is constituted by a length of a rigid metallic tubular member which encloses and supports centrally therein a rigid portion of the electrical conductor. These rigid conductor enclosing section are joined together by means of short flexible sections of the tubular enclosing member and a corresponding flexible portion of the conductor thereby to enable the connected together rigid sections to be bent through an angle of substantially 180 degrees to facilitate transport from the fabrication point to a remote location for on site installation.

U.S. Pat. No. 5,561,640, issued Oct. 1, 1996, to W. C. Maciejewski, discloses a sonar array cable typically provided in lengths comprising hydrophone arrays and associated electronics and transmitter can components, with each cable length or section having one of each of these components housed therein. These sections are relatively stiff and unbendable, requiring that they be connected with relatively bendable intermediate segments. These intermediate segments are susceptible to excessive bending that can lead to failure of the wiring provided therebetween. The wiring in these intermediate bendable segments is provided in the form of a coil, each coil is rigidly connected to the transmitter and electronics in one cable section, and the other end of the coil being connected electrically to the wiring associated with the hydrophone array in an adjacent cable section. Each coil is encased in relatively soft urethane material, preferably in one portion of the bendable segment, another portion of the bendable segment having the coil connected at its other end to a relatively still urethane material associated with the transmitter can and associated electronics.

U.S. Pat. No. 4,346,953, issued Aug. 31, 1982, to Carnaghan et al., discloses a flexible coupling assembly for a radio antenna of a submarine buoyant cable antenna system is connected in a cable line that retains the characteristics of the cable as regards the outside diameter, flexibility tensile strength and electrical continuity. The assembly comprises flexible co-axial connectors at each end keyed to an insulator that press fit in a transition piece. The transition piece is press fit into the tubing by barbed type annular rings machined into the transition piece. Between the insulators and enclosed by the tubing are plastic pieces connected by a coil spring.

U.S. Pat. No. 5,745,436, issued Apr. 28, 1998, to S. H. Bittleston, discloses a semi-dry marine seismic streamer cable that consists of a number of connected streamer cable sections which each comprise a mechanical jacket surrounding a hollow core enclosing the seismic sensor and signal transfer means. Elongated axial stress elements for transmitting axial loads and a radial reinforcement member for relieving radial loads are provided in the jacket. The core is filled with a fluid or fluid saturated foam and the sensor means are mounted in the core by vibration isolating elements.

The above cited prior art discloses buoyant antenna cables which, at best, are limited in frequency range and which are limited as to the types of antennas which can be used therewith. It would be desirable to provide an antenna structure formed of flexible buoyant material that, after deployment by a submerged vessel, realizes a designed shape. Those skilled in the art will appreciate the present invention that addresses the above and other problems.

SUMMARY OF THE INVENTION

Accordingly, it is an object of the present invention to provide an improved buoyant cable system.

It is another object of the present invention to provide a suitable shape for a towed platform that is flexible during deployment.

It is yet another object of the present invention to provide an improved towed platform that may be constrained into a relatively rigid structure after deployment.

It is yet another object of the present invention to provide an improved platform with one or more curves that provide support in the water.

These and other objects, features, and advantages of the present invention will become apparent from the drawings, the descriptions given herein, and the appended claims.

In accordance with the present invention, a buoyant, flexible antenna system is operable for use in water with a transmission line. The system comprises elements such as, for instance, articulating blocks that form a linear platform for towing in the water with the transmission line. The blocks have engagement faces such that when the plurality of blocks is compressed, then the linear platform takes on a preselected shape. The selected shape may have one or more curved sections that extend outwardly away from a theoretical centerline of the at least one linear platform. In a preferred embodiment, one or more antennas mounted to the at least one linear platform.

A biasing mechanism may be used to constrain the blocks with sufficient force to thereby constrain the blocks into the desired position. The biasing mechanism may be of several types including spring bias. Other types of bias may utilize water flow to induce a compression force such as with extendable/retractable fins to activate and deactivate the blocks into the desired position. A plurality of strands (46, 48, 50, FIG. 6 hereinafter), such as Kevlar®, or other strands preferably extends through the plurality of blocks to hold the blocks adjacent to each other. (Kevlar® is an aromatic polyamide fiber manufactured and sold by Du Pont de Nemours Company.) In one embodiment, a rotary connector is preferably utilized between the linear platform and the transmission line. For instance, if a weight is mounted to a curved portion of the transmission line with a rotary connector utilized between the platform and transmission line, then the weighted curved portion may act as a keel for supporting the antenna in a desired position. The weight may be mounted at an apex of the curved portion.

In another embodiment, the linear platform may comprise a first curved section and a second curved section such that the first curved section and the second curved section extend outwardly from the theoretical centerline in opposite directions.

A method for fitting up a buoyant cable system in accord with the present invention may comprise steps such as, for instance, connecting a plurality of blocks together to form a flexible linear construction for attachment to a transmission line wherein the flexible construction and the transmission line may be deployable into water. The method may include steps such as providing the plurality of blocks with interconnection surfaces such that the linear construction may have memory of a selected shape. Other steps may include mounting an antenna with respect to the flexible linear construction. Moreover the method may comprise steps such as providing that the selected shape has one or more curves therein and/or providing a curved shape to form a keel for supporting the antenna. Additional steps may include threading the blocks together with one or more strands and biasing the blocks to thereby constrain the blocks into the selected shape.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout several views of the drawings and wherein.

DESCRIPTION OF THE PREFERRED EMBODIMENTS

The present invention utilizes a buoyant cable antenna that can be deployed by a submerged submarine. Moreover, the present invention can be used to provide extended frequency range capability to a buoyant cable antenna system. Besides increased frequency band reception, the antenna may provide improved frequency gain and pattern enhancements. Referring to FIG. 1 through FIG. 7, it is illustrated that the shaped platforms 10 and 10A, possible examples of which are illustrated, are placed in a flexible tube 11, FIG. 7, and encapsulated in a foam outer jacket 11', FIG. 7, in order to provide buoyancy. The flexible construction permits passage through deployment mechanisms. Thus, a construction is provided that is flexible yet has memory to remember the desired shape after deployment.

Figure 1:
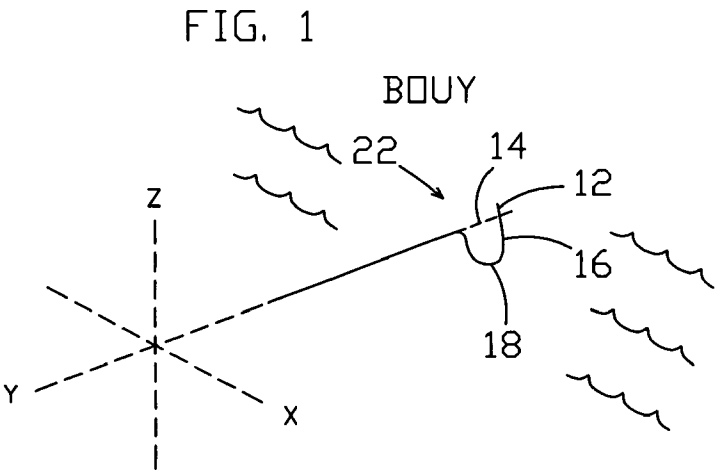
FIG. 1 is a schematic diagram of one embodiment of a curved cable antenna in accord with the present invention, which is presented in a relationship of perspective in which the x-y-z Cartesian coordinate reference axes therein are oriented with the x-y axes in the plane of the water line diagrammatically represented by waves therein.
Figure 2:
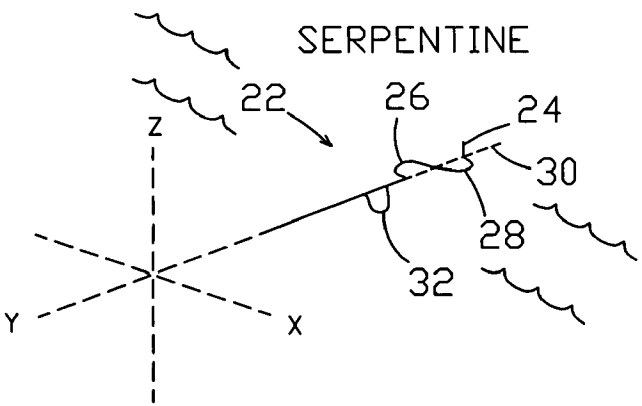
FIG. 2 is a like schematic diagram of another embodiment of a curved cable antenna in accord with the present invention.

Referring now to the drawings, and more particularly to FIG. 1 and FIG. 2, there are shown two possible embodiments of desirably shaped antenna buoyant platforms 10 and 10A, respectively, in accord with the present invention. Other shapes and constructions may also be used that avoid the problems of being limited to a horizontal wire antenna. However, the present invention can also be used in conjunction with a horizontal wire antenna.

Figure 3:
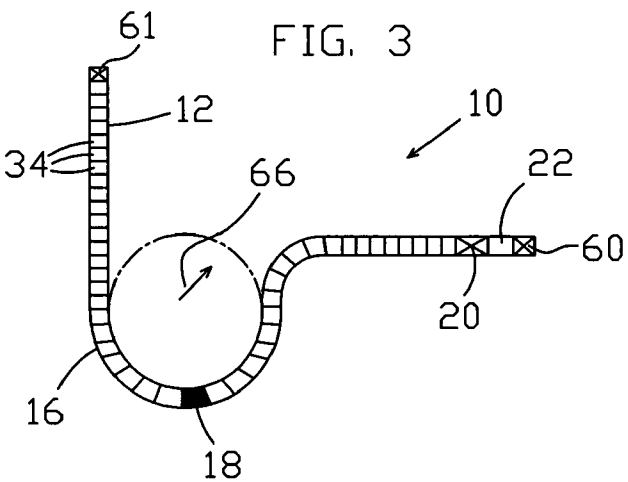
FIG. 3 is a diagrammatic view of a curved antenna comprised of articulating blocks in buoy form in accord with the present invention.

In FIG. 1 and FIG. 3, towed platform 10 provides what may be referred to as a buoy construction. In the buoy construction, a portion of the antenna, such as portion 12, may actually protrude, or vertically stand, above water line (as represented by the x-y plane of the Cartesian reference axes in FIG. 1.), if desired. However, if desired, the entire antenna can remain at or near the surface of the water without extending above the water. Towed platform 10 provides a keel portion 16 that may be curved to place keel portion vertically below water surface x-y to thereby provide a net upward buoyant force that positions portion 12 vertically upstanding from water surface x-y, if desired. For this purpose, keel portion 16 may be substantially U-shaped or at least be formed in a curved shape. Theoretical centerline or principal longitudinal tow axis 14 of towed platform 10 may typically also be at the approximate water surface during towing, as represented by axis coinciding with the "y" axis of the reference Cartesian axes in FIG. 1. Curved portions such as keel portion 16 extend outwardly from theoretical centerline 14. In one embodiment, keel portion 16 is weighted at apex 18 to effectively provide a weighted keel that provides vertical stability to section 12. Because section 12 thereby remains in an operational upright position, section 12 may provide a suitable position on platform 10 for mounting a vertical antenna or other antennas. Rotary joint 20 may be used to permit rotation of keel portion 16 with respect to transmission line 22 to thereby stabilize upright positioning and avoid the towing effects that might otherwise rotate or twist transmission line 22.

Section 12 or other portions of platform 10 could be comprised of many different types of antenna constructions. For instance, some antennas suitable for placement at section 12 might include monopole antennas, dipole antennas, helical antennas, spiral antennas, patch antennas, and the like. Such antennas are well known to have a wide range of frequency capabilities and can be designed for many frequency gain patterns. Thus, the present invention may be used to thereby utilize a wide range of different types of antennas, only a few of which have been mentioned. The antenna may be mounted only at section 12 or may be mounted anywhere along towed platform 10 and may, if desired, be used in conjunction with a horizontal wire type antenna mounted to transmission line 22. Moreover, multiple antennas may be mounted to towed platform 10, at the same or at various positions, if desired.

Figure 4:
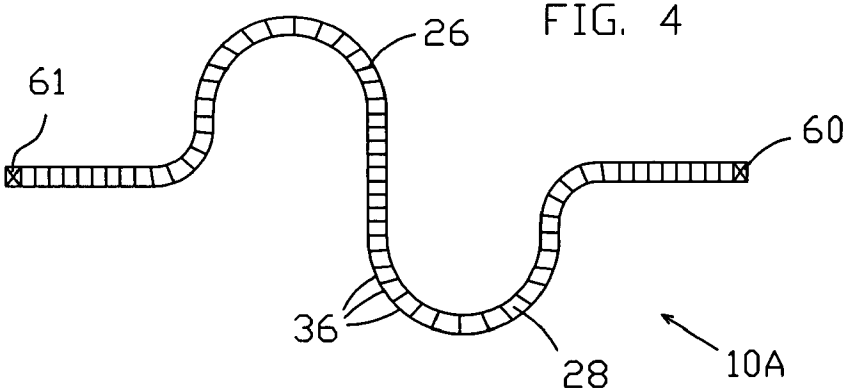
FIG. 4 is a diagrammatic view of another embodiment of a curved antenna comprised of articulating blocks in serpentine form in accord with the present invention.

Referring to FIG. 2 and FIG. 4, the serpentine shape of towed platform 10A also provides a stable platform for a vertical antenna section 24 which may also extend out of water line, if desired. Towed platform 10A has two curves 26 and 28, both of which are buoyant to thereby float near or on water surface as represented by centerline or principal tow axis 30 of the buoyant antenna platform 10A coinciding with the "y" axis of the reference Cartesian axes shown in FIG. 3. First curve 26 thereby counterbalances second curve 28 so as to support vertical antenna section 24, if used, in a vertical position during towing. Towed platform 10A may or may not include a keel section 32 which may be weighted for even more stability.

More particularly, FIG. 3 and FIG. 4 disclose one embodiment of the present invention that comprises articulating blocks that provide a flexible structure with memory. The systems of 10 and 10A may be formed from a plurality of blocks such as blocks 34 or blocks 36. It will be apparent that blocks such as blocks 34 in system 10 are arranged in the buoy format while blocks such as blocks 36 in system 10A are arranged in the serpentine format. Blocks in system 10 and 10A may either be in a constrained or relatively rigid position or may be unconstrained so as to provide for flexibility during deployment. Moreover, the blocks may be biased as discussed hereinafter such that sufficient force is provided to maintain the desired shape but the force is sufficiently limited so the platform is flexible for deployment.

Figure 5:
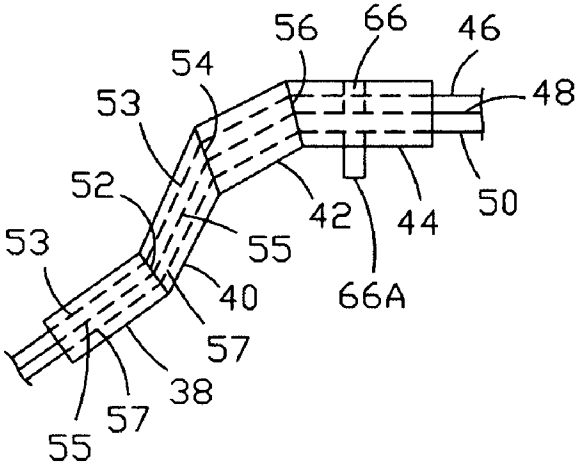
FIG. 5 is a diagrammatic view of a plurality of articulating blocks that when compressed together are aligned in a selected form.

Referring now to FIG. 5, an enlarged section of articulating blocks, such as representative articulating blocks 38, 40, 42, and 44, are shown. The blocks may be of varied shape and size, if desired. Alternatively, the blocks may have substantially the same diameter. The desired shape is provided by minor variations in the face, such as faces 52, 54, and 56. Thus, the present invention is not limited to any particular size and shape for the articulating blocks. In another embodiment, identical blocks could be used and wedges or structures placed between the identical blocks to thereby produce the desired shape when the blocks are constrained together. The blocks may insulate the foam jacket in order to increase buoyancy.

Each articulating block is held in a relative position with cables such as Kevlar® strands 46, 48, and 50. (Kevlar® is an aromatic polyamide fiber manufactured and sold by Du Pont de Nemours Company.) There may be more Kevlar® strands as desired, however, three are shown as an example. The Kevlar® strands may extend through apertures 53, 55, and 57 which extend through the blocks.

When it is desired for the group of articulating blocks to assume a selected position, then the blocks are constrained to move against each other with sufficient force. The various faces such as faces 52, 54, and 56 then cause the articulating blocks to assume a desired position such as the positions shown in FIG. 1-FIG. 4 or other positions. When it is desired for the blocks to form a flexible assembly, then the blocks are permitted to move away from each other to thereby permit significant flexing. The constraining force may therefore either be variable so as to vary or the constraining may be a selected constant force that also permits flexing.

Figure 6:
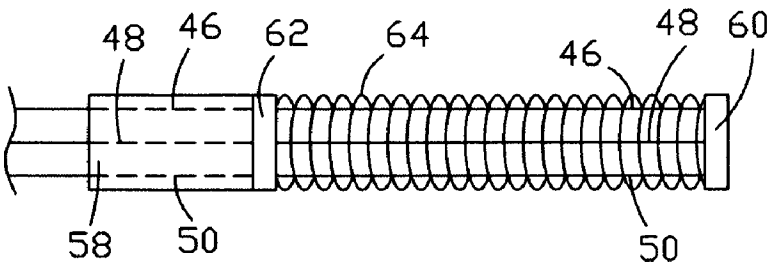
FIG. 6 is a diagrammatic view of a biasing mechanism for constraining the articulating blocks into alignment in accord with the present invention.
Figure 7:
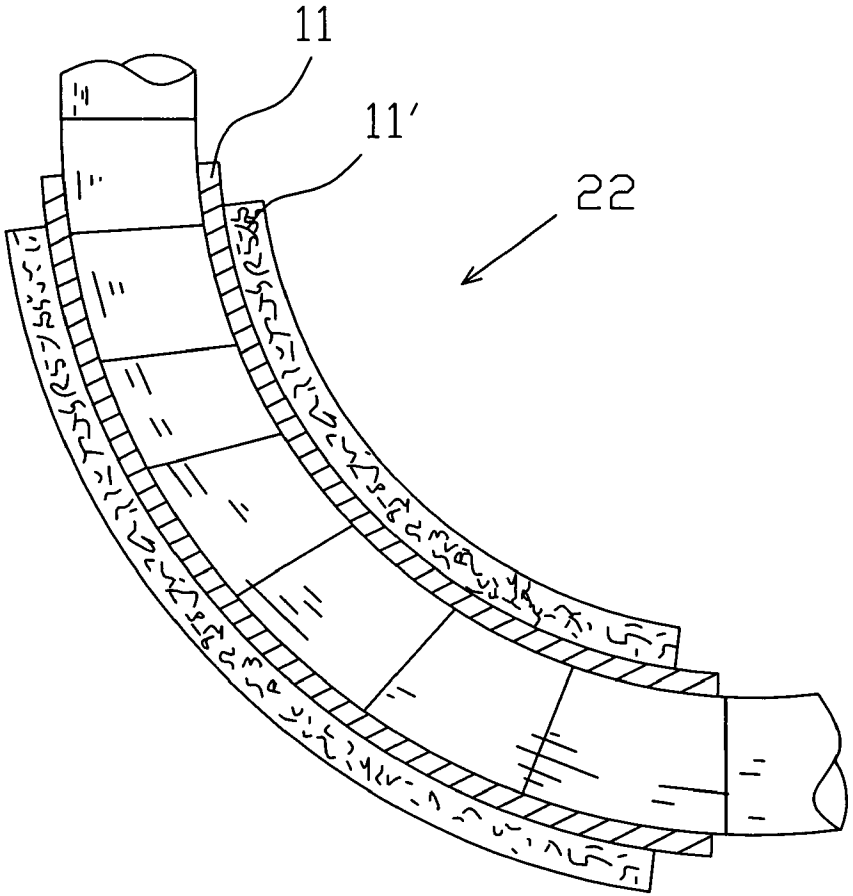
FIG. 7 is a segment of the curved cable antenna of FIG. 1, partly in side elevation and party in section, showing details related to the cable antenna's buoyancy.

FIG. 6 shows one possible constant biasing system for constraining the articulating blocks to move against each other, although other biasing systems may be used. In FIG. 6, Kevlar® strands 46, 48, and 50 have one of their ends connected to a Kevlar® and antenna buoyant platform termination bulkhead 60 (also shown in FIGS. 3 and 4) at one end of the set of articulating blocks forming the platform. The other ends of the strands are connected to another Kevlar® and antenna buoyant platform bulkhead 61, FIGS. 3 and 4, at the other end of each buoyant platform. Kevlar® strands 46, 48, and 50 pass through second spring stop bulkhead 62. Spring 64 is mounted to bulkhead 60 and second bulkhead 62. Spring 64 biases bulkhead 60 to tighten Kevlar® strands 46, 48, and 50 that extend through passageways in second bulkhead 62 and the articulating blocks such as block 58. As tension is applied to the Kevlar® strands, then the articulating blocks are constrained to move against each other. In this way, the various faces and the Kevlar® strands constrain the articulating blocks of the antenna structure to take the desired shape. The spring should be sufficiently strong to maintain the desired shape during towing but should be limited in compression to permit sufficient flexibility for deployment and retrieval. For example, such sufficiency of flexibility may permit coiling with a spooling radius 66, FIG. 3.

Other biasing means could also be used such as a biasing mechanism that produces a variable force. For instance, extendable elements such as elements 66 (See unextended element 66 in FIG. 5) could be selectively extended. When extended as shown at 66A, the pressure of flowing water against element 66A causes the lead block, which might be block 44, to compress the subsequent blocks together. When retracted, as shown at 66, the pressure is removed, the blocks are not compressed against each other and so the cable is flexible. Retractable elements could be operated by relays, servomotors, and the like, as desired.

While curved shapes are shown herein for platforms 10 and 10A, other shapes such as triangles, rectangular shapes, and the like could also be provided.

In summary, the present invention preferably provides a suitable platform for towing that comprises a plurality of blocks. The blocks are constructed such that a constraining force will cause the blocks to be formed into a desired shape. The desired shape is conducive to improved radio reception and may be used as a platform for many different types of antennas. It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A flexible antenna system operable for use in water with a transmission line, said system comprising:

at least one linear platform for towing in said water with said transmission line, said at least one linear platform being comprised of a plurality of blocks, said blocks having engagement surfaces there between such that when said plurality of blocks is compressed then said at least one linear platform has a selected predetermined shape;

at least one antenna mounted to said at least one linear platform; and a rotary connector connecting said at least one linear platform and said transmission line.

2. The system of claim 1, further comprising:

at least one foam jacket for said plurality of blocks, said at least one foam jacket providing sufficient buoyancy force for said plurality of blocks to cause said plurality of blocks to be biased so as to move upwardly to a surface of water; and a plurality of strands extending through said plurality of blocks.

3. The system of claim 2, further comprising a biasing mechanism for compressing said plurality of blocks together.

4. The system of claim 1, wherein said predetermined selected shape further comprises:

a first curved section; and a second curved section such that said first curved section and said second curved section extend outwardly from a theoretical centerline in opposite directions.

5. The system of claim 1, further comprising a weight for orienting said linear platform with said predetermined selected shape with said water.

6. A method for assembling and deploying a buoyant cable system, said method comprising the steps of:

connecting a plurality of blocks together to form a flexible linear construction for attachment to a transmission line, said flexible construction and said transmission line being deployable into water;

providing said plurality of blocks with interconnection surfaces that are related to a selected shape;

compressing said plurality of blocks together to thereby form said selected shape; and providing that said selected shape has at least one curve therein.

7. The method of claim 6, further comprising:

interconnecting said plurality of blocks together with a plurality of strands;

securing said plurality of strands to opposing bulkheads at each end of said transmission line; and slidably mounting said plurality of blocks between said opposing bulkheads to said plurality of strands.

8. The method of claim 6, further comprising providing two opposing curves to form a platform for supporting said antenna.

9. The method of claim 6, further comprising supporting an antenna with said selected shape in said water.

10. The method of claim 6, further comprising:

connecting said plurality of blocks together with a plurality of strands, said strands comprising an aromatic polyamide fiber.

11. The method of claim 6, wherein said step of compressing further comprises utilizing a spring for biasing said plurality of blocks against each other.

12. The method of claim 6, wherein said step of compressing further comprises utilizing water pressure for compressing said plurality of blocks against each other.

13. A buoyant, flexible antenna system operable for use in water with a transmission line, said system comprising:

a linear construction comprising a plurality of blocks interconnected together, said blocks fitting together such that when compressed said plurality of blocks have a selected shape with at least one curve, said linear construction being sized for deployment underwater with said transmission line into said water; and at least one antenna supported on said linear construction.

14. The system of claim 13, further comprising a biasing element for compressing said plurality of blocks together.

15. The system of claim 13, further comprising a plurality of strands for interconnecting said plurality of blocks.

16. The system of claim 15, wherein said strands are comprised of aromatic polyamide fiber having terminations at bulkheads disposed on opposite ends of said transmission line.

17. The system of claim 13, wherein said selected shape further comprises:

two opposing curves; and a weighted keel formed from a curved portion of said flexible linear construction.

18. The system of claim 17, further comprising a rotary connector that connects said linear construction with said transmission line.

* * * * *